US005184699A

United States Patent [19]

Aoki et al.

[11] Patent Number: 5,184,699

[45] Date of Patent: Feb. 9, 1993

[54] CONTROL DEVICE FOR FORKLIFT

[75] Inventors: Kanji Aoki; Yukio Uchiyama; Toshiyuki Midorikawa, all of Sagamihara, Japan

[73] Assignees: Mitsubishi Jukogyo Kabushiki Kaisha, Tokyo; MHI Sagami High Technology & Control, Kanagawa, both of Japan

[21] Appl. No.: 830,570

[22] Filed: Feb. 5, 1992

[30] Foreign Application Priority Data

Feb. 5, 1991 [JP] Japan ..... 3-10419[U]

[51] Int. Cl.[5] ..... B66B 9/20

[52] U.S. Cl. ..... 187/9 R; 74/491; 414/631; 137/625.66

[58] Field of Search ..... 187/9 R, 9 E; 74/491, 74/471 R; 414/630, 628, 631; 137/625.66, 487.5, 625.64

[56] References Cited

U.S. PATENT DOCUMENTS 3,014,344 12/1961 Arnot ..... 187/9 R
4,817,760 4/1989 Yamamura ..... 187/9 R
5,011,363 4/1991 Conley, III et al. ..... 187/9 R

*Primary Examiner*—Robert P. Olszewski
*Assistant Examiner*—Kenneth Noland
*Attorney, Agent, or Firm*—Nixon & Vanderhye

[57] ABSTRACT

In a control device for forklift on which a flow control signal is sent from a controller in accordance with a manipulated variable of work machine lever operated by the operator and this flow control signal regulates the degree of opening of an electromagnetic proportional control valve in an oil pipe line to control the working speed of lift cylinders, the degree of opening of the electromagnetic proportional control valve is regulated by a flow control signal having a characteristic such that the value of flow control signal changes in accordance with the load of lift cylinders in the inching zone where the manipulated variable of work machine lever is relatively small, which improves the operability in the inching zone.

4 Claims, 6 Drawing Sheets

CONTROL DEVICE FOR FORKLIFT

FIELD OF THE INVENTION AND RELATED ART STATEMENT

This invention relates to a control device for forklift. More particularly it relates to a control device applied usefully to an electronically controlled forklift on which the degree of opening of electromagnetic proportional control valve is controlled in accordance with an electrical signal in response to the manipulated variable of work machine lever output by the operation of work machine lever.

As publicly known, the forklift is an industrial vehicle for cargo handling which has masts for raising/lowering a cargo at the front part of the vehicle and can move from position to position.

The conventional mechanical forklift has recently been replaced by the electronically controlled forklift rapidly. On the mechanical forklift, the manipulated variable of the operation lever is transmitted to a control valve via a mechanical linkage, and the control of the degree of opening of the control valve regulates the quantity of oil so that the speed of raising/lowering is controlled. Whereas, the electronically controlled forklift preforms the necessary control by operating the work machine lever with far lighter operating power.

FIG. 6 is a block diagram showing the control device for an electronically controlled forklift according to the conventional technology together with the hydraulic system. As shown in this figure, work machine levers 01*a*, 01*b* are the levers for controlling the operation of hydraulic cylinders 02*a*, 02*b*, for raising/lowering and tilting, respectively. The work machine levers send lever manipulation signals, which are electrical signals corresponding to the manipulated variables of levers, to controller 03. These work machine levers 01*a*, 01*b* are usually installed near the operator's seat so that the operator sitting on the operator's seat of forklift can easily operate them. The controller 03 processes the lever manipulation signal and sends flow control signals, which are electrical signals for controlling the degree of opening of electromagnetic proportional control valves 04*a*, 04*b*. The electromagnetic proportional control valves 04*a*, 04*b* regulate the degree of opening by moving a spool via a pilot pressure in accordance with the flow control signal so as to control the rate of flow of pressure oil flowing in oil pipe lines 05*a*, 05*b*.

The control system is configured in such a manner that the flow control signal has a characteristic shown in FIG. 7 in relation to the manipulated variable of the work machine lever 01*a*, 01*b*. As seen from this figure, this characteristic has a dead zone (1) set in a specified range near the neutral position of the work machine lever 01*a*, 01*b* and a work zone (2) exceeding the dead zone (1). In the figure, the right side of the neutral point N indicates the raising and forward tilting mode and the left side indicates the lowering and backward tilting mode.

The flow control signal is an electric current signal corresponding to the position of work machine lever 01*a*, 01*b* when the work machine lever 01*a*, 01*b* is in the work zone (2). In the inching zone (3), the change of signal is small in relation to the manipulated variable of the work machine 01*a*, 01*b*. In the normal zone (4), the change of signal is large in relation to the manipulated variable of the work machine lever 01*a*, 01*b*. Thus, by setting the raising/lowering and tilting rate at a relatively low value in the inching zone (3) and at a relatively high value in the normal zone (4), excellent workability and harmonization with working speed are provided.

FIG. 8(*a*) is a diagram in which a portion of raising mode is extracted from FIG. 7. FIG. 8(*b*) is a characteristic diagram showing the rate of flow (the degree of opening of the electromagnetic proportional control valve 04*a*) of oil flowing in the oil pipe line 05*a* when the electromagnetic proportional control valve 044*a* is controlled by the flow control signal of the characteristic shown in FIG. 8(*a*), as a function of the manipulated variable of the work machine lever 01*a*.

The characteristics A, B, C, D, and E shown in FIG. 8(*b*) indicate the measurement results obtained by changing the load raised by the lift cylinder 02*a*. The load is increased stepwise from A to E. It is apparent from FIG. 8(*b*) that the characteristic A, which indicates lightest load, is similar to the characteristic shown in FIG. 8(*a*), and it is found that as the load increases, the dead zone (1) of operation of the electromagnetic proportional control valve 04*a* expands from (1)A to (1)B, (1)C, (1)D and (1)E, and accordingly the inching zone (3) decreases from (3)A to (3)B, (3)C, (3)D and (3)E. In the normal zone (4), the difference in the rate of flow based on the load decreases as the manipulated variable approaches the maximum value, and the rate of flow is constant at the maximum manipulated variable independently of the load.

Thus, particularly in the inching zone (3), where the controlled variable of work machine lever 01*a* is small, the deviation of the flow control signal from the actual flow in the oil pipe line 05*a* increases with the increase in load. This is because the movement of spool of the electromagnetic proportional control valve 04*a* is inhibited in accordance with the load acting on the pressure oil, and the degree of inhibition is larger when the moving distance of spool is small and the rate of flow is low. The change of the width of inching zone (3) due to the load impairs the operation feeling, jeopardizing the workability, particularly at a high load, in which the inching zone (3) is narrow. At a high load, the load is not raised even when the work machine lever 01*a* is operated, and once the load begins to be raised, the inching zone (3) is passed in a short time and soon the work zone (4) is entered; therefore, the actual raising of load is different from the operation feeling of the operator.

A combination of an electromagnetic proportional control valve and a flow control valve has been used particularly in construction machines to keep the rate of flow at the raising time at a constant value independently of load, ensuring good maneuverability. However, this system requires an additional flow control valve, which increases the cost.

OBJECT AND SUMMARY OF THE INVENTION

Accordingly, it is an object of this invention to provide a control device for forklift which has a uniform inching characteristic in relation to each load without the use of a flow control valve.

In other words, it is an object of this invention to provide a control device for forklift which has an inching characteristic exactly reproducing actual operation feeling by providing a specified degree of opening of the electromagnetic proportional control valve in response to the manipulated variable of work machine lever independently of the load.

It is another object of this invention is to provide a control device for forklift which keeps a continuous inching zone for a certain period of time independently of the load.

The first feature of this invention to attain the above objects is as follows:

a control device for forklift has (a) a work machine lever for sending a lever manipulation signal which is an electrical signal corresponding to the manipulated variable, (b) a controller for forming and sending a flow control signal, in accordance with the lever manipulation signal, which is an electrical signal whose change is relatively small in relation to the manipulated variable in the inching zone where the manipulated variable is relatively small, and whose change is relatively large in the normal zone which is adjacent to this inching zone and where the manipulated variable is relatively large, and (c) an electromagnetic proportional control valve which regulates the rate of flow of pressure oil flowing in an oil pipe line for controlling the action of hydraulic cylinders by regulating the degree of opening in accordance with the flow control signal, in which said control device for forklift comprises, (d) oil pressure detecting means which is disposed in said oil pipe line for supplying pressure oil for hydraulic cylinders for raising/lowering and detects a pressure of oil flowing in said oil pipe line to send an oil pressure signal which is an electric signal representing this pressure, and (e) said controller sends a flow control signal of higher predetermined value when the load is heavy even if the manipulated variable is equal, in accordance with the load for the hydraulic cylinders for raising/-lowering detected on the basis of the oil pressure signal in the inching zone.

The second feature of this invention to attain the above objects is as follows:

A control device for forklift comprises (a) a work machine lever for sending a lever manipulation signal which is an electrical signal corresponding to the manipulated variable, (b) a controller for forming and sending a flow control signal, in accordance with the lever manipulation signal, which is an electrical signal whose change is relatively small in relation to the manipulated variable in the inching zone where the manipulated variable is relatively small, and whose change is relatively large in the normal zone which is adjacent to this inching zone and where the manipulated variable is relatively large, and (c) an electromagnetic proportional control valve which regulates the rate of flow of pressure oil flowing in an oil pipe line for controlling the action of hydraulic cylinders by regulating the degree of opening in accordance with the flow control signal, and the controller sends a flow control signal which increases stepwise for a predetermined manipulated variable and changes at the same slope in the inching zone.

According to the first feature of this invention, the electromagnetic proportional control valve is controlled by the flow control signal in accordance with the load, that is, by the flow control signal set at a high value when the load is heavy in the inching zone. As a result, the degree of opening of electromagnetic proportional control valve is constant in relation to the manipulated variable of work machine lever independently of the load.

According to the second feature of this invention, the flow control signal has a characteristic of increasing stepwise and at the same slope in the inching zone, so that the flow control signal corresponding to the load, even though it is heavy, is supplied to the electromagnetic proportional control valve. As a result, an inching zone continuing for a certain period of time can be ensured independently of the load.

DETAILED DESCRIPTION OF PREFERRED EMBODIMENTS

The embodiments of this invention will be described in detail below with reference to FIGS. 1 through 5.

Figure 4:
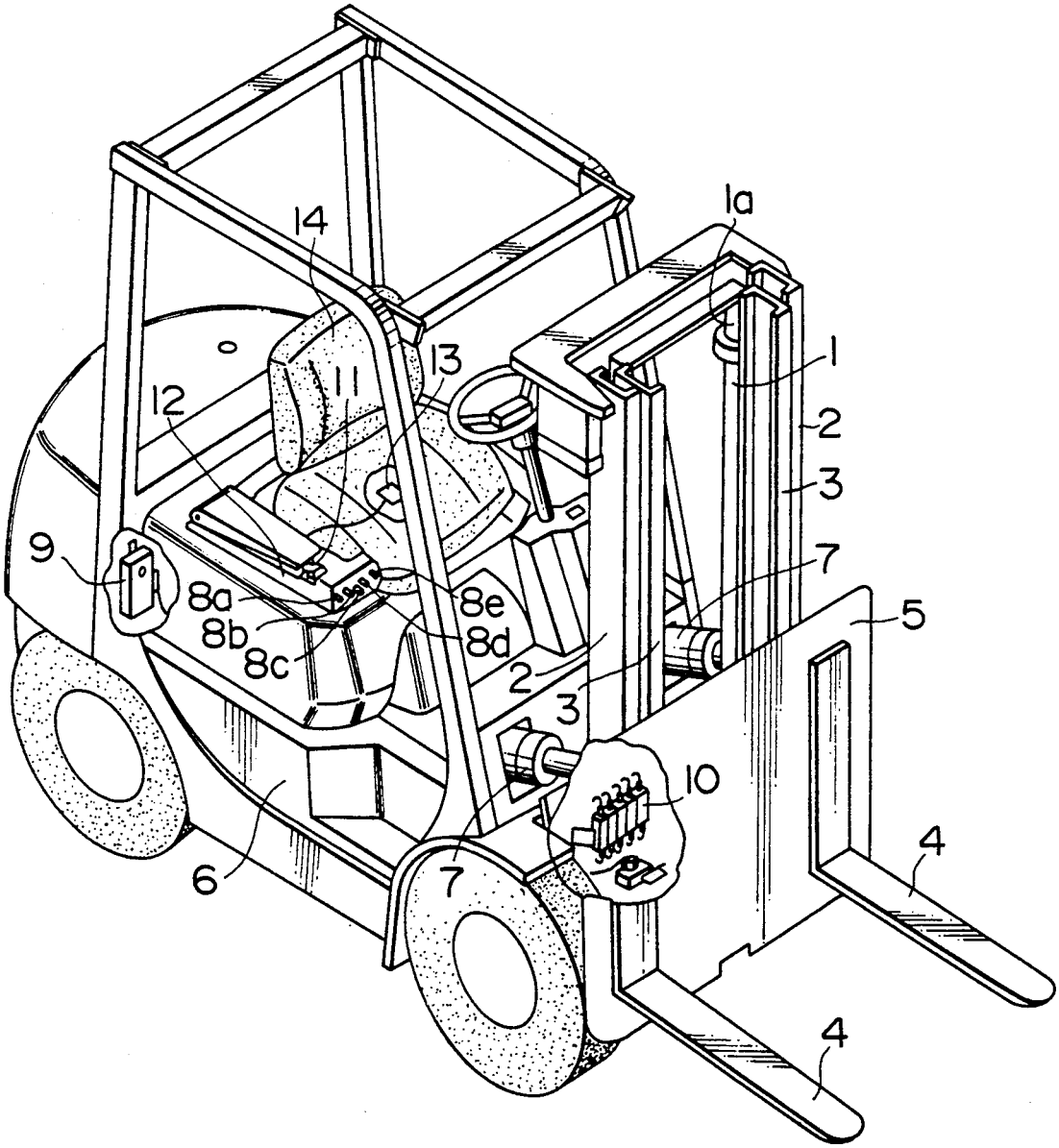
FIG. 4 is a perspective view of a forklift to which the embodiments of this invention are applied.

FIG. 4 is a perspective view of a typical forklift to which the embodiments of this invention are applied. As indicated in this figure, lift cylinders 1 are fixedly secured to a pair of right and left outer masts 2, so that a pair of right and left inner masts 3 are raised/lowered with the outer masts 2 being used as guides when piston rods 1*a* are extended or retracted. The inner masts 2 are fixed to the vehicle body 6 at the front part of the vehicle body 6. Therefore, a lift portion consisting of a bracket 5 depended from chains (not shown) and a fork 4 for directly carrying a cargo is raised/lowered as the inner masts 3 are raised/lowered.

Tilt cylinders 7 act to tilt the lift portion as well as the outer masts 2 and inner masts 3 forward (away from the vehicle body 6) or backward (toward the vehicle body 6). The lift portion is tilted forward when a cargo is unloaded, and backward when a cargo is lifted and carried so that respective workability is kept good and safety is ensured.

Work machine levers 8*a*, 8*b* are operated by the operator to control lift cylinders 1 and tilt cylinders 7 via a controller 9 and an electromagnetic proportional control valve 10. These levers are housed in a joy stick box 12 together with a safety switch 11 for emergency stop. Work machine levers 8c, 8d, 8e are spare levers for various attachments such as a roll clamp and a bail clamp. A seat switch 13 is activated when the operator is seated on the operator's seat 1, whose output signal is sent to the controller 9.

Figure 5:
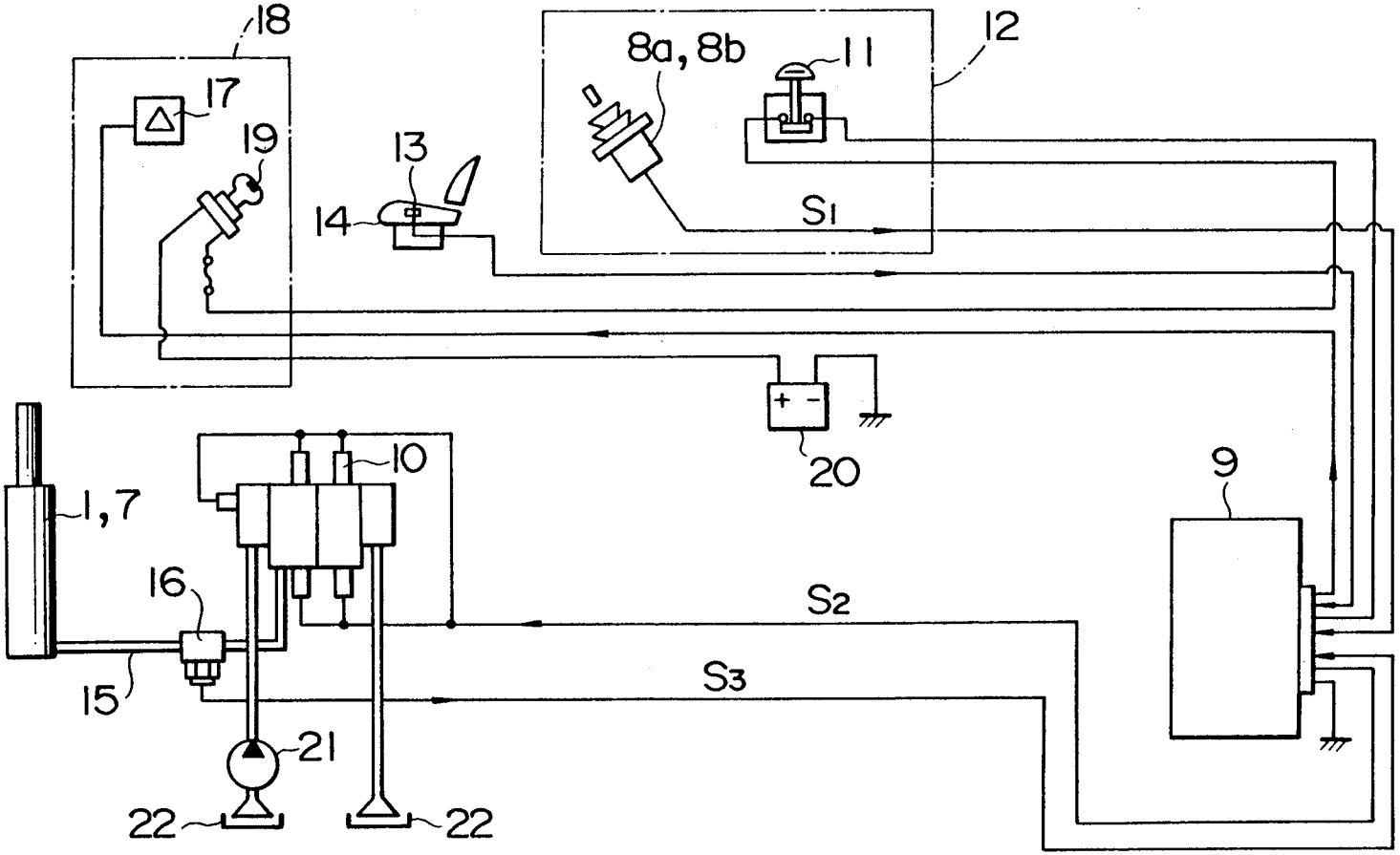
FIG. 5 is a control circuit diagram of the entire control device according to an embodiment of this invention.
Figure 6:
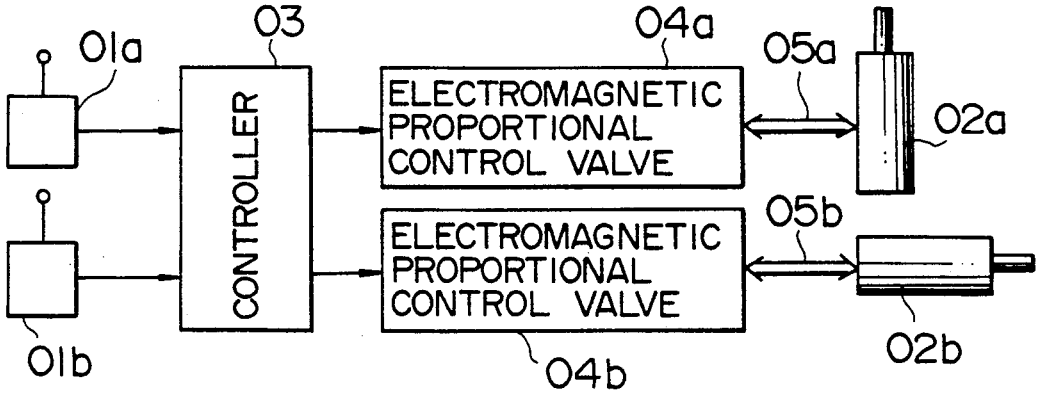
FIG. 6 PRIOR ART
FIG. 6 is a block diagram showing the control device for forklift of prior art.
Figure 7:
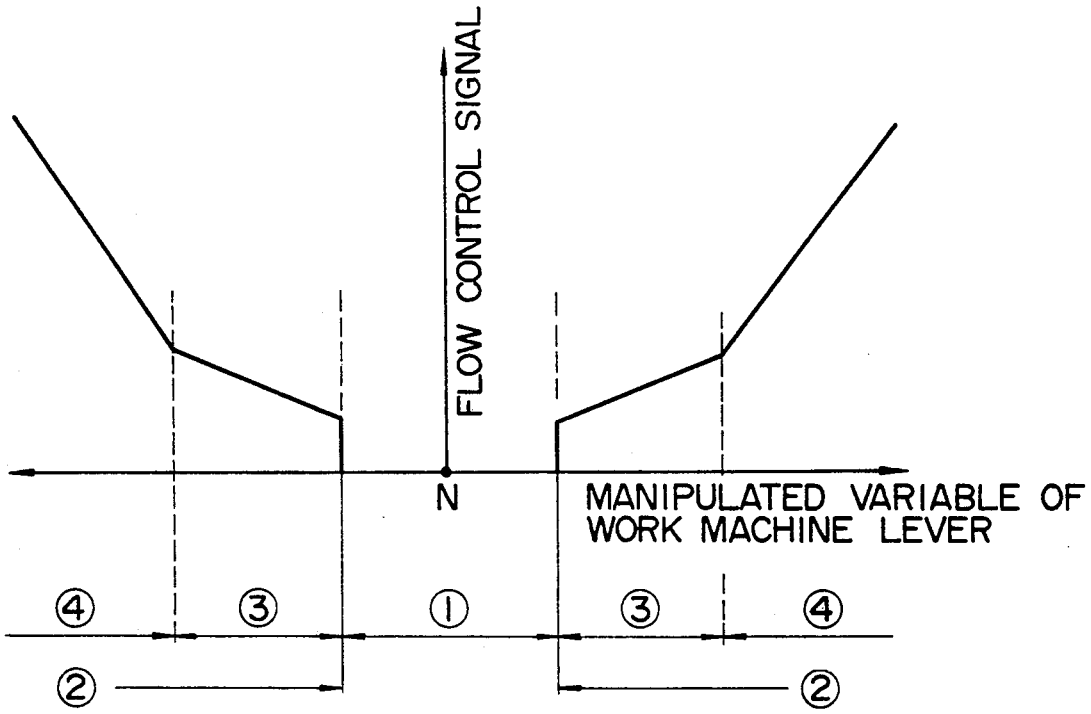
FIG. 7 PRIOR ART
FIG. 7 is a graph showing the relationship between the manipulated variable of work machine lever and the flow control signal for the control device shown in FIG. 6, and FIGS. 8(*a*) and 8(*b*) are graphs comparing the relationship between the manipulated variable of work machine lever and the flow control signal and the relationship between the manipulated variable and the rate of flow.

FIG. 5 is a circuit diagram of a typical control device for the above-described forklift. In this figure, the same reference numerals are applied to the same elements as those in FIG. 4, and the repeated explanation is omitted.

The work machine lever 9a, 9b, consisting of a potentiometer, sends a lever manipulation signal $S_1$, in which the current value is proportional to the manipulated variable, to the controller 9 as shown in FIG. 5. The controller 9 sends a flow control signal $S_2$, which controls the degree of opening of spool in the electromagnetic proportional control valve 10 in accordance with the lever manipulation signal $S_1$. The electromagnetic proportional control valve 10 controls the flow of oil in an oil pipe line 15 owing to its spool moving in proportion to the magnitude of flow control signal $S_2$, so that the working speeds of lift cylinders 1 and tilt cylinders 7 are controlled in response to the manipulated variable of work machine lever 8a, 8b.

An oil pressure sensor 16 is disposed in the oil pipe line 15 to send an oil pressure signal $S_3$ representing the pressure of oil in this oil pipe line 15.

The controller 9 processes the oil pressure signal $S_3$ and performs operations on the load acting on the lift cylinders 1 and tilt cylinders 7. In addition, the controller 9 is activated by electric power supplied by a battery 20 when a starter switch 19 housed in a console box 18 together with a warning lamp 17 is turned on. When the safety switch 11 is on and the seat switch 13 is off, the controller 9 carries out control in such a manner that the current value of the flow control signal $S_2$ is zero and the degree of opening of the electromagnetic proportional control valve 10 is zero.

In FIG. 5, reference numeral 21 denotes a hydraulic pump, and 22 denotes a hydraulic oil source. The number of components in the hydraulic system such as the electromagnetic proportional control valve 10, the oil pipe line 15, and the oil pressure sensor 16 corresponds to the number of the work machine levers 8a through 8e. In this embodiment, two hydraulic systems are installed since the machine has two work machine levers 8a, 8b for raising/lowering and tilting.

Figure 1:
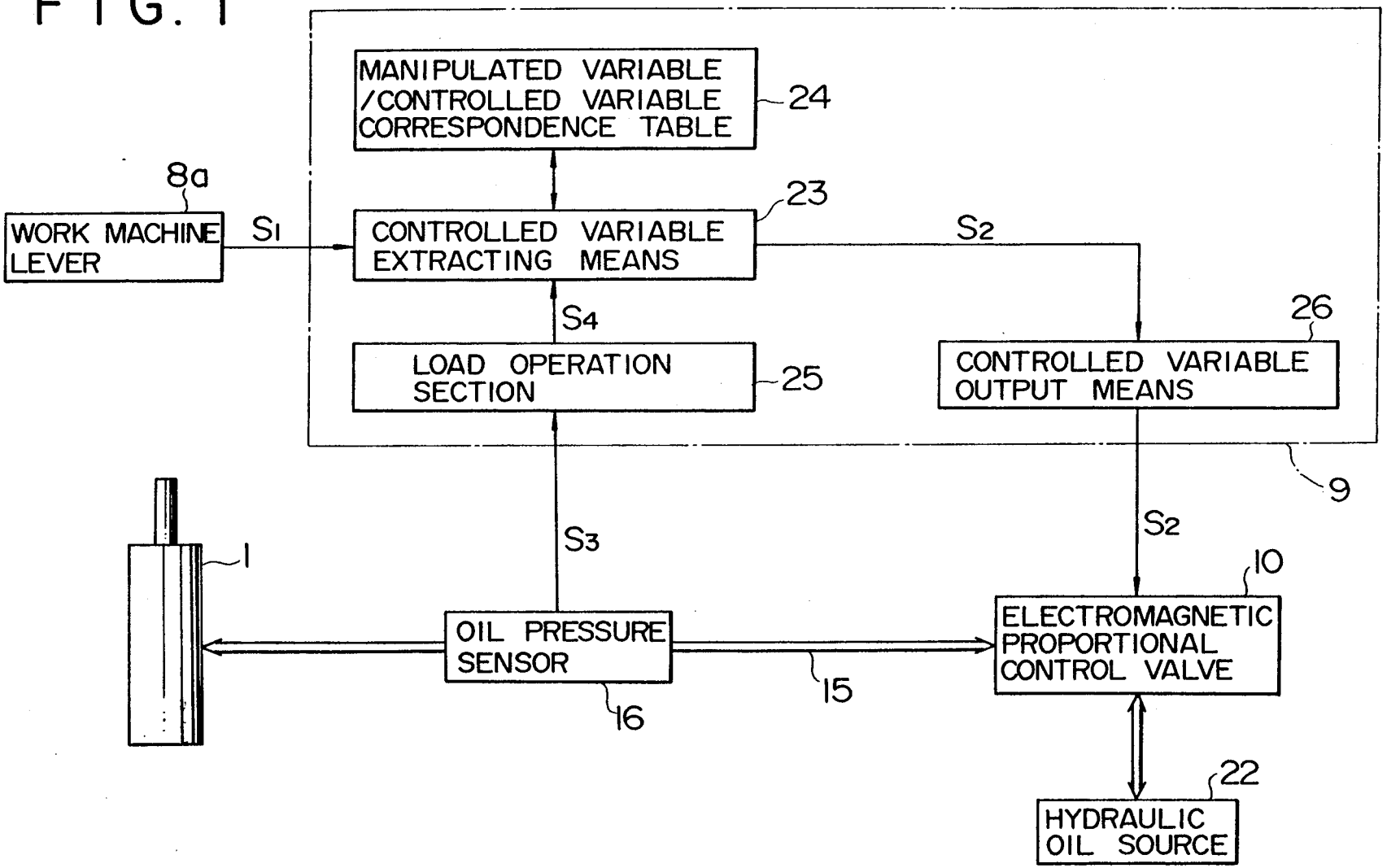
FIG. 1 is a block diagram showing the main portion extracted from the control device according to an embodiment of this invention.

FIG. 1 is a block diagram showing the main portion extracted from the control device of an embodiment. In this figure, the same reference numerals are applied to the same elements as those in FIGS. 4 and 5, and the repeated explanation is omitted.

As indicated in FIG. 1, the lever manipulation signal $S_1$ sent by the work machine lever 8a is supplied to the controlled variable extracting means 23. The controlled variable extracting means 23 sends the flow control signal $S_2$ representing the controlled variable of the electromagnetic proportional control valve 10 corresponding to the lever manipulation signal $S_1$ by referring to the manipulated variable/controlled variable correspondence table, in accordance with a load signal $S_4$ representing the load computed in load operation section 25. The load operation section 25 computes the load acting on the lift cylinders 1 in accordance with the oil pressure signal $S_3$ representing the pressure of oil in the oil pipe line 15 detected by an oil pressure sensor 16.

Figure 2:
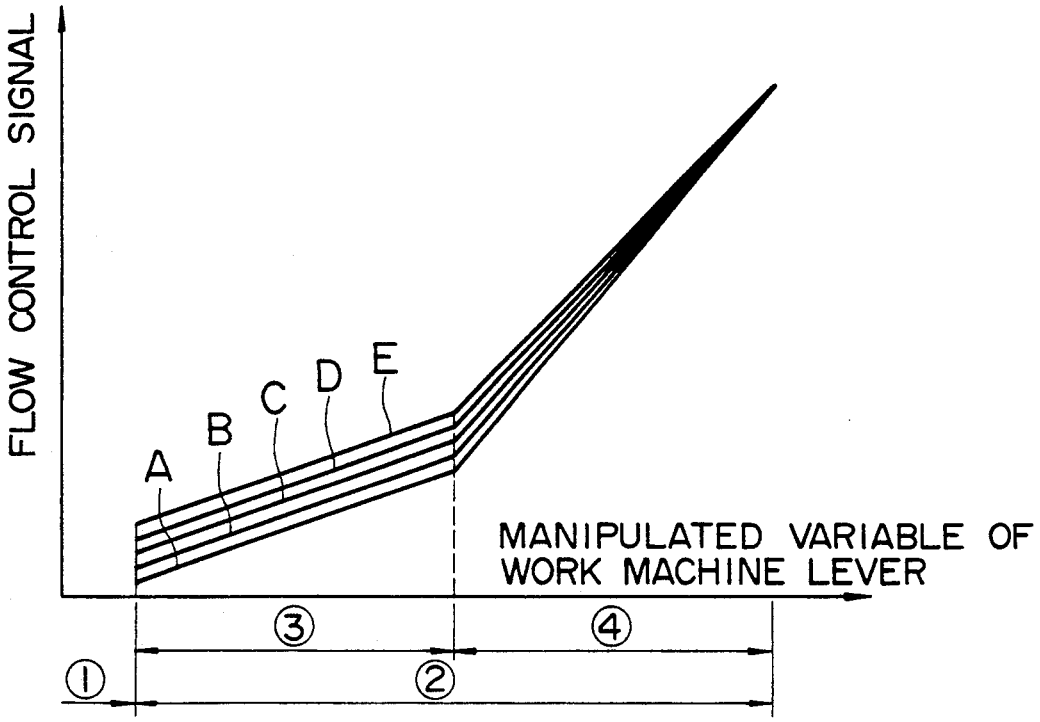
FIG. 2 is a graph showing the characteristic of flow control signal according to a first embodiment of this invention.

The manipulated variable/controlled variable correspondence table 24 stores a table of characteristics A, B, C, D, E as shown in FIG. 2 for the raising mode of lift cylinder 1. This table has five kinds of values of flow control signal in accordance with the load signal $S_4$ in the inching zone (3), so that any one of characteristics A through E corresponding to the load can be selected. The characteristic A is for the lightest load; as the load increases, characteristic is changed over stepwise to B, C, and D in that sequence, and characteristic E is selected when the load is heaviest. These characteristics A through E correspond to the load which gives the characteristic A through E in FIG. 8(b). As the load is greater, the current value of the flow control signal $S_2$ becomes higher even when the manipulated variable of work machine lever 8a is equal.

A controlled variable output means 26 sends the flow control signal $S_2$ fed from a controlled variable extracting means 23 to the electromagnetic proportional control valve 10.

According to the above embodiment, when the load is heavy, the flow control signal $S_2$ corresponding to that load is supplied to the electromagnetic proportional control valve 10, so that the degree of opening is controlled to keep a specified degree of opening though the movement of spool is inhibited with a relatively great force by the reaction of pressure oil in accordance with the load. Therefore, the degree of opening of the electromagnetic proportional control valve 10 corresponding to the same manipulated variable of work machine lever 8a is nearly constant independently of the load, ensuring an inching characteristic exactly reproducing actual operation feeling.

Figure 3:
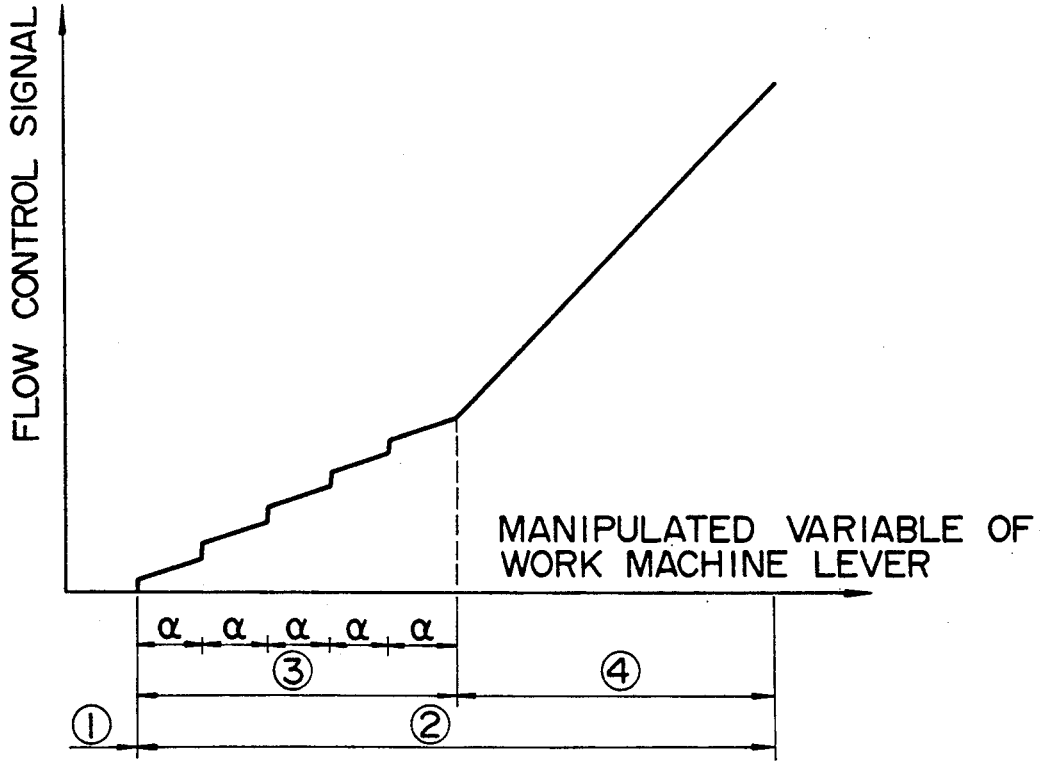
FIG. 3 is a graph showing the characteristic of flow control signal according to a second embodiment of this invention.

The table stored in the manipulated variable/controlled variable correspondence table may be a table having a characteristic shown in FIG. 3 for the raising mode of lift cylinder 1. This table is formed so that the value of flow control signal $S_2$ increases stepwise for each predetermined manipulated variable $\alpha$ and changes at the same slope in the inching zone (3).

According to this embodiment, a zone where the current value is relatively high is present in the inching zone (3) for each manipulated variable $\alpha$, so that the flow control signal $S_2$ of necessary current value can be supplied to the electromagnetic proportional control valve 10 in response to the load, which enables the lift cylinders 1 to perform a specified action corresponding to the inching operation of work machine lever 8a. When the load is heavy, the inching zone (3)A through (3)E in the rate of flow of pressure oil (refer to FIG. 8) becomes wider than before.

Figure 8A:
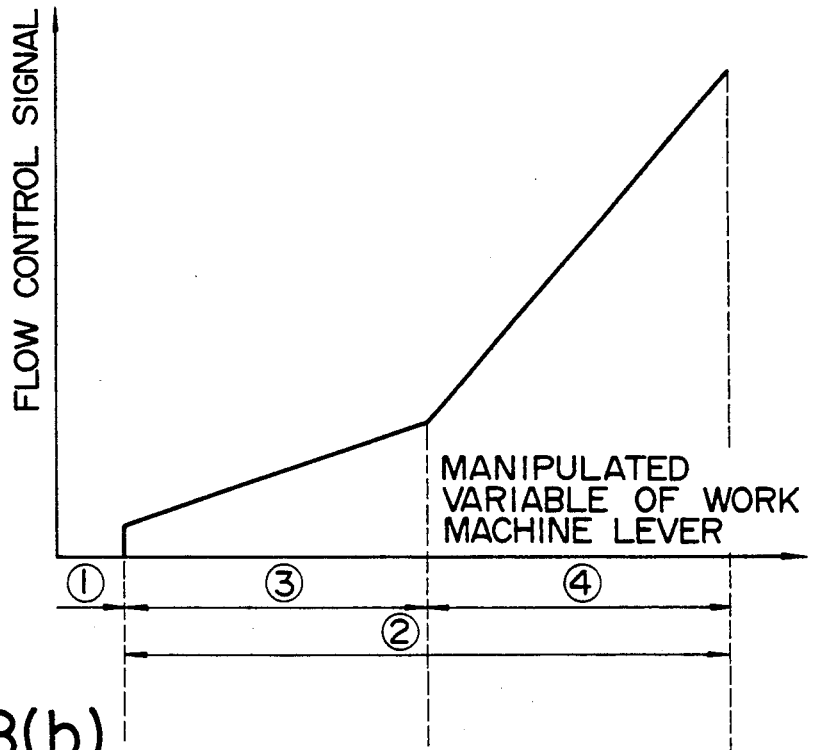
FIG. 8(a) PRIOR ART
Figure 8B:
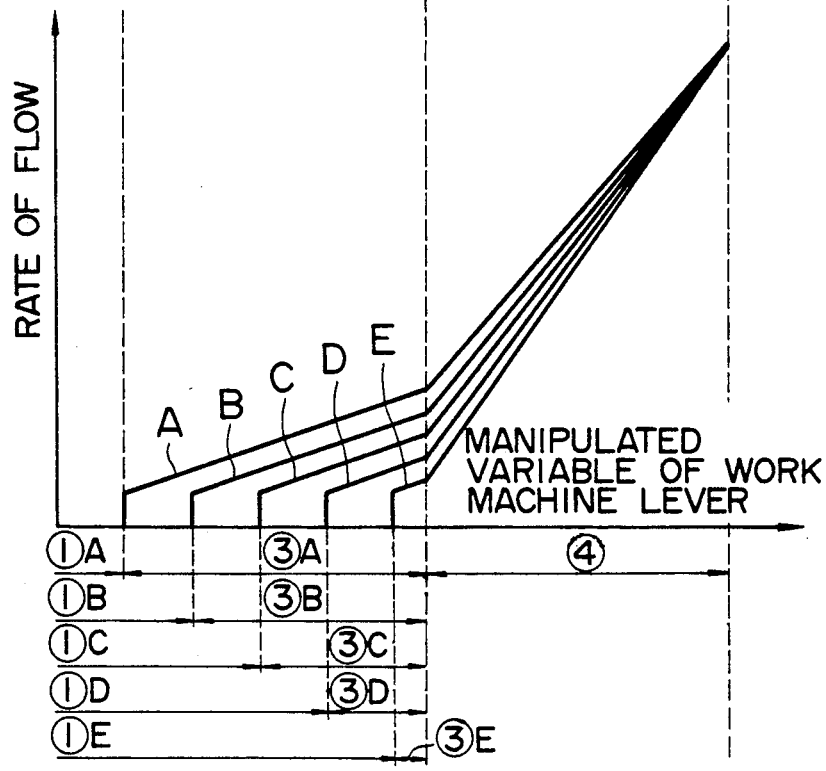
FIG. 8(b) PRIOR ART

In FIGS. 2 and 3, the same reference numerals are applied to the same elements as those in FIG. 8(a).

The embodiment shown in FIG. 1 is applied to the control of raising, but it is not limited to this case. It naturally can be applied, for example, to the control of tilt cylinders in tilting if the inching characteristic is affected by the load. Even in this case, the information about the load is obtained from the oil pressure sensor of lift cylinder.

As described specifically with embodiments, according to this invention, the flow control signal of a value corresponding to the load can be supplied to the electromagnetic proportional control valve in the inching zone even when the load is heavy, so that the inching characteristic matching the operation feeling of work machine lever independently of the load can be obtained, which ensures cargo handling work of good manipulation control.

We claim:

1. A control device for forklift having:

(a) a work machine lever for sending a lever manipulation signal which is an electrical signal corresponding to a manipulated variable, (b) a controller for forming and sending a flow control signal, in accordance with said lever manipulation signal, which is an electrical signal whose change is relatively small in relation to the manipulated variable in an inching zone where said manipulated variable is relatively small, and whose change is relatively large in a normal zone which is adjacent to this inching zone and where said manipulated variable is relatively large, and (c) an electromagnetic proportional control valve which regulates the rate of flow of pressure oil flowing in an oil pipe line for controlling the action of hydraulic cylinders by regulating the degree of opening in accordance with said flow control signal, in which said control device for forklift comprises, (d) oil pressure detecting means which is disposed in said oil pipe line for supplying pressure oil for hydraulic cylinders for raising/lowering and detects a pressure of oil flowing in said oil pipe line to send an oil pressure signal which is an electric signal representing this pressure, and (e) said controller sends a flow control signal of higher predetermined value when the load is heavy even if the manipulated variable is equal, in accordance with the load for the hydraulic cylinders for raising/lowering detected on the basis of the oil pressure signal in the inching zone.

2. A control device for forklift according to claim 1 wherein said controller for sending said flow control signal comprises controlled variable extracting means to which said lever manipulation signal is sent, a load operation section which sends a load signal to said controlled variable extracting means in accordance with the oil pressure signal sent from said oil pressure detecting means, a manipulated variable/controlled variable correspondence table for determining the flow control signal sent from said controlled variable extracting means in accordance with said lever manipulation signal and load signal, and controlled variable output means for sending said flow control signal to said electromagnetic proportional control valve.

3. A control device for forklift according to claim 2 wherein said manipulated variable/controlled variable correspondence table stores tables of a plurality of characteristics, and the characteristic is selected by being changed over in a stepwise mode as the load increases, so that the current value of said flow control signal increases as the load increases even if said manipulated variable of work machine lever is equal.

4. A control device for forklift comprising:

(a) a work machine lever for sending a lever manipulation signal which is an electrical signal corresponding to a manipulated variable, (b) a controller for forming and sending a flow control signal, in accordance with said lever manipulation signal, which is an electrical signal whose change is relatively small in relation to the manipulated variable in an inching zone where said manipulated variable is relatively small, and whose change is relatively large in a normal zone which is adjacent to this inching zone and where said manipulated variable is relatively large, and (c) an electromagnetic proportional control valve which regulates the rate of flow of pressure oil flowing in an oil pipe line for controlling the action of hydraulic cylinders by regulating the degree of opening in accordance with said flow control signal, wherein said controller sends a flow control signal which increases stepwise for a predetermined manipulated variable and changes at the same slope in the inching zone.

* * * * *